US008740716B1

(12) United States Patent
Mallonee

(10) Patent No.: US 8,740,716 B1
(45) Date of Patent: Jun. 3, 2014

(54) GOLF BALL EJECTION DEVICE

(76) Inventor: Jerry Mallonee, Conover, NC (US)

( * ) Notice: Subject to any disclaimer, the term of this patent is extended or adjusted under 35 U.S.C. 154(b) by 229 days.

(21) Appl. No.: 13/334,899

(22) Filed: Dec. 22, 2011

(51) Int. Cl.
*A63B 57/00* (2006.01)

(52) U.S. Cl.
USPC ..... 473/177

(58) Field of Classification Search
USPC ..... 473/173–179; 254/1, 242, 393, 394; 414/416.09, 422, 745.2; 294/209, 19.2
See application file for complete search history.

(56) References Cited

U.S. PATENT DOCUMENTS

| | | | | | |
|---|---|---|---|---|---|
| 979,313 | A | * | 12/1910 | King et al. | 473/177 |
| 1,402,026 | A | * | 1/1922 | Waddell | 473/177 |
| 1,599,734 | A | | 9/1926 | Wilson | |
| 1,673,852 | A | * | 6/1928 | Underwood et al. | 473/177 |
| 1,723,859 | A | * | 8/1929 | Hummel | 473/176 |
| 1,776,161 | A | | 9/1930 | Lockwood | |
| 1,826,641 | A | * | 10/1931 | Waddell | 473/177 |
| 1,918,994 | A | * | 7/1933 | Stutz | 473/177 |
| 3,790,166 | A | * | 2/1974 | Hamilton et al. | 473/177 |
| 4,114,879 | A | | 9/1978 | Oiler | |
| 4,290,603 | A | | 9/1981 | Barnes | |
| 4,496,150 | A | | 1/1985 | McGlew | |
| 4,552,358 | A | | 11/1985 | McGlew | |
| 5,393,053 | A | | 2/1995 | Wiese et al. | |
| 5,480,142 | A | * | 1/1996 | Ackerman | 473/178 |
| 5,734,102 | A | * | 3/1998 | Stevens | 73/170.05 |
| 6,409,609 | B1 | | 6/2002 | Brezic | |
| 2009/0137331 | A1 | * | 5/2009 | Hansen | 473/176 |
| 2011/0086719 | A1 | | 4/2011 | Long | |
| 2012/0196691 | A1 | * | 8/2012 | Maclean | 473/172 |

FOREIGN PATENT DOCUMENTS

| | | |
|---|---|---|
| CA | 226570 | 11/1922 |

* cited by examiner

*Primary Examiner* — Mark Graham
(74) *Attorney, Agent, or Firm* — Michael I. Kroll

(57) ABSTRACT

A golf ball ejection device integrated into a golf flag pin whereby balls sitting in the hole-cup are raised to ground level and expelled outward therefrom in random directions and distances. This is accomplished by apply manual pressure to a slidable component of the flag pin that raises a dome shaped ejector component positioned within the hole-cup thereby ejecting the golf balls contained therein, which also prevents balls from falling back into the cup.

5 Claims, 13 Drawing Sheets

GOLF BALL EJECTION DEVICE

BACKGROUND OF THE INVENTION

1. Field of the Invention

The present invention relates generally to golf flag pins and, more specifically, to a golf ball ejection device integrated into a golf flag pin whereby balls sitting in the hole-cup are raised to ground level and expelled outward therefrom in random directions and distances.

This is accomplished by apply manual pressure to a slidable component of the flag pin that raises a dome shaped ejector component positioned within the hole-cup, which also prevents balls from falling back into the cup.

The golf ball ejection device of the present invention provides an embodiment where an ejector sleeve that is slidably mounted on the mast rod is raised using a golf club or by hand the attached dome shaped ejector raises approximately to the hole-cup lip whereupon the curved surface of the dome shaped ejector causes the balls to travel in a random fashion away from the cup.

Furthermore, the present invention provides an embodiment where the ejector sleeve and attached dome shaped ejector resting at the base of the hole-cup is raised when pressure is applied to a mushroom shaped palm button located on the top of the flag pin mast, which causes the mast rod which is tethered to the ejector sleeve to raise the ejector-sleeve dome to approximately ground level thereagain expelling the hole-cup balls radially in random fashion.

The golf ball ejection device of the present invention allows a golfer to repetitiously practice their putting without having to retrieve golf balls from the hole-cup then randomly spread the balls out for another round of putting practice. It should also be noted that varying the pressure on the ejector component can vary the distance the balls travel from the hole-cup thereby allowing the golfer to practice long or short putts or any distance therebetween.

2. Description of the Prior Art

There are other golf ball devices primarily designed for picking up golf balls. While these golf ball devices may be suitable for the purposes for which they were designed, they would not be as suitable for the purposes of the present invention as heretofore described.

SUMMARY OF THE PRESENT INVENTION

The instant invention is a golf ball ejection device wherein the user simply raises or lowers a convex cone by simply raising or releasing the lower rod—then automatically falls back into position (according to the cable configuration) a push rod that is telescopically disposed within a stationary outer tube with cables disposed therebetween for raising and lowering a convex cone disposed in the bottom of the cup that upon reaching ground level extricates and expels any golf balls therein to increase the ease for the user to continue to practice on putting green or collect the balls afterward.

Note: Once the rod is pushed down—expelling the golf balls in a radius around the cup at various distances and preventing any golf balls from falling back into the cup—it automatically falls back to the bottom of the cup—the bottom convex cone is weighted to make this action happen.

Review: Prior art is a fixed rod with a small basket attached at bottom that goes into the bottom of the cup—user had to raise rod and basket attached to remove the balls—often the balls would fall back into the cup and user had to bend over to eject.

This invention lets the user simply push the top of the rod—the convex cone rises to ground level and expels balls outward in a radius that forms around the cup and prevents any balls from falling back into the cup. The user then simply lets go of the push rod and the mechanism automatically falls back in place at the bottom of the cup.

A primary object of the present invention is to provide a ball ejector device for a golf-green hole-cup actuateable through manual manipulation of a component of the golf flag pin of the present invention.

Another object of the present invention is to provide a flag pin comprising a mast rod and an ejector sleeve.

Yet another object of the present invention is to provide a flag pin where the ejector sleeve encompasses a portion of the mast rod and is slideable along the mast rod.

Still yet another object of the present invention is to provide the mast rod with a hole-cup removable-anchor member.

An additional object of the present invention is to provide a removable-anchor member comprising a ferrule plug to accommodate a golf-green hole-cup having a hole-cup ferrule.

A further object of the present invention is to provide said ferrule plug with spaced apart peripheral rings serving as frictional elements to engage the interior wall of the hole-cup ferrule.

A yet further object of the present invention is to provide a hole-cup removable-anchor member for a hole-cup without a hole-cup ferrule consisting of a planar plate fixed to the base of the mast rod having a shape substantially conforming to the shape of the hole-cup base.

A still yet further object of the present invention is to provide said planar plate and said hole-cup base each with a mating fastener element, such as hook and loop, to releasably secure the flag pin planar plate to the base of the hole-cup.

Another object of the present invention is to provide the mast rod with an ejector-sleeve stop limiting the travel of the ejector sleeve along the mast rod.

Yet another object of the present invention is to provide the ejector sleeve with an ejector-sleeve dome positioned approximately at the base of the ejector sleeve having a circumference substantially conforming to the base of the hole-cup.

Still yet another object of the present invention is to provide a circumferential lifter projecting from the ejector sleeve exterior surface forming a hook so that a golf club can be used to raise the ejector sleeve to a point where golf balls within the hole-cup are radially ejected by virtue of the ejector-sleeve dome that rises to a predetermined height determined by the location of the mast-rod ejector-sleeve stop, preferably the base of the dome is approximately ground level when raised.

An additional object of the present invention is to provide a golf flag pin further comprising a mast sleeve.

A further object of the present invention is to provide a flag pin where the mast rod is slideable within the mast sleeve.

A yet further object of the present invention is to provide the mast rod with a mountable and dismountable flag so that varied events can be noted through placement of designer flags.

A still yet further object of the present invention is to provide the mast rod with a flag barrel for mounting a desired flag there on with the flag barrel having a flag-barrel bore for mounting the flag barrel onto the mast rod.

Another object of the present invention is to provide the mast rod with a flag-barrel stop that may be integrally manufactured with the mast rod or adjustably fastenable by providing a flag-barrel stop with a bore for selectively positioning and fastening the flag-barrel stop onto the mast rod.

Yet another object of the present invention is to provide the mast rod with a palm button having a palm-button mast seat providing means for mounting the palm button to the top of the mast rod.

Still yet another object of the present invention is to provide a mast sleeve having a top end and a bottom end with a through bore therebetween.

An additional object of the present invention is to fixedly attach the bottom end of the mast sleeve with a ferrule plug.

A further object of the present invention is to alternately provide the ferrule plug with spaced apart peripheral rings serving as frictional elements to engage the interior wall of the hole-cup ferrule.

A yet further object of the present invention is to provide the mast sleeve top end with a mast-sleeve cap having a mast-sleeve cap bore for receiving reciprocal motion of the mast rod there through.

A still yet further object of the present invention is to optionally provide a bushing positioned within said mast-sleeve cap bore to aid in the movement of the mast rod there through.

Another object of the present invention is to provide the mast rod with a mast-rod stop having a mast-rod stop bore for mounting said mast-rod stop onto the mast rod limiting the movement of the mast rod through the mast sleeve with the mast-rod stop fixedly attached to the mast rod below the mast-sleeve cap.

Yet another object of the present invention is to provide the mast rod with a fastener approximately positioned at the base of the mast rod for securing at least one line to said fastener.

Still yet another object of the present invention is to provide the mast-sleeve cap with peripheral cavities for passing line there through.

An additional object of the present invention is to provide the ejector sleeve with a top end and a bottom end having a bore passing there through with said bore serving as housing for the mast sleeve.

A further object of the present invention is to provide the ejector sleeve top end with an ejector-sleeve cap having an ejector-sleeve cap bore for receiving reciprocal motion of the mast rod there through.

A yet further object of the present invention is to optionally provide a bushing positioned within said ejector-sleeve cap bore to aid in the movement of the mast rod there through.

A still yet further object of the present invention is to provide an ejector sleeve with an ejector-sleeve dome positioned approximately at the base of the ejector sleeve with the dome base having a circumference substantially conforming to the base of the hole-cup.

Another object of the present invention is to fixedly attach lines fasten to the mast-rod line fastener then passing the lines through a respective mast-sleeve cap cavity and fixedly attaching their free ends to the ejector-sleeve dome so that when a downward pressure is applied to the mast rod, preferably through the palm button, the ejector sleeve will rise to a predetermined height limited by the location of the mast-rod ejector-sleeve stop, preferably the dome base is approximately ground level when raised, thereby ejecting any golf balls contained within the hole-cup.

Yet another object of the present invention is to provide a golf ball ejection device wherein said dome is weighted to provide a gravity feed that will lower the weighted dome back into said hole-cup.

Still yet another object of the present invention is to provide a golf ball ejection device that prevents expelled golf balls from falling back into the hole-cup through judicious placement of the ejector-sleeve stop.

An additional object of the present invention is to provide an ejection device that may be adapted for use in industry.

A further object of the present invention is to provide a golf ball ejection device that is inexpensive to manufacture and operate.

A yet further object of the present invention is to provide a golf ball ejection device that is simple and easy to use.

Additional objects of the present invention will appear as the description proceeds.

The present invention overcomes the shortcomings of the prior art by providing a golf ball ejection device wherein the user simply raises or lowers a dome-shaped convex cone by simply raising the outer ejector rod then releasing the ejector rod which then automatically falls back into position or by applying a downward pressure on a cabled mast rod that is telescopically disposed within a stationary mast sleeve with cables disposed between the mast rod and the ejector sleeve having the dome-shaped convex cone disposed in the bottom of the cup that upon reaching ground level extricates and expels any golf balls therein to increase the ease for the user to continue to practice on putting green or collect the balls afterward.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
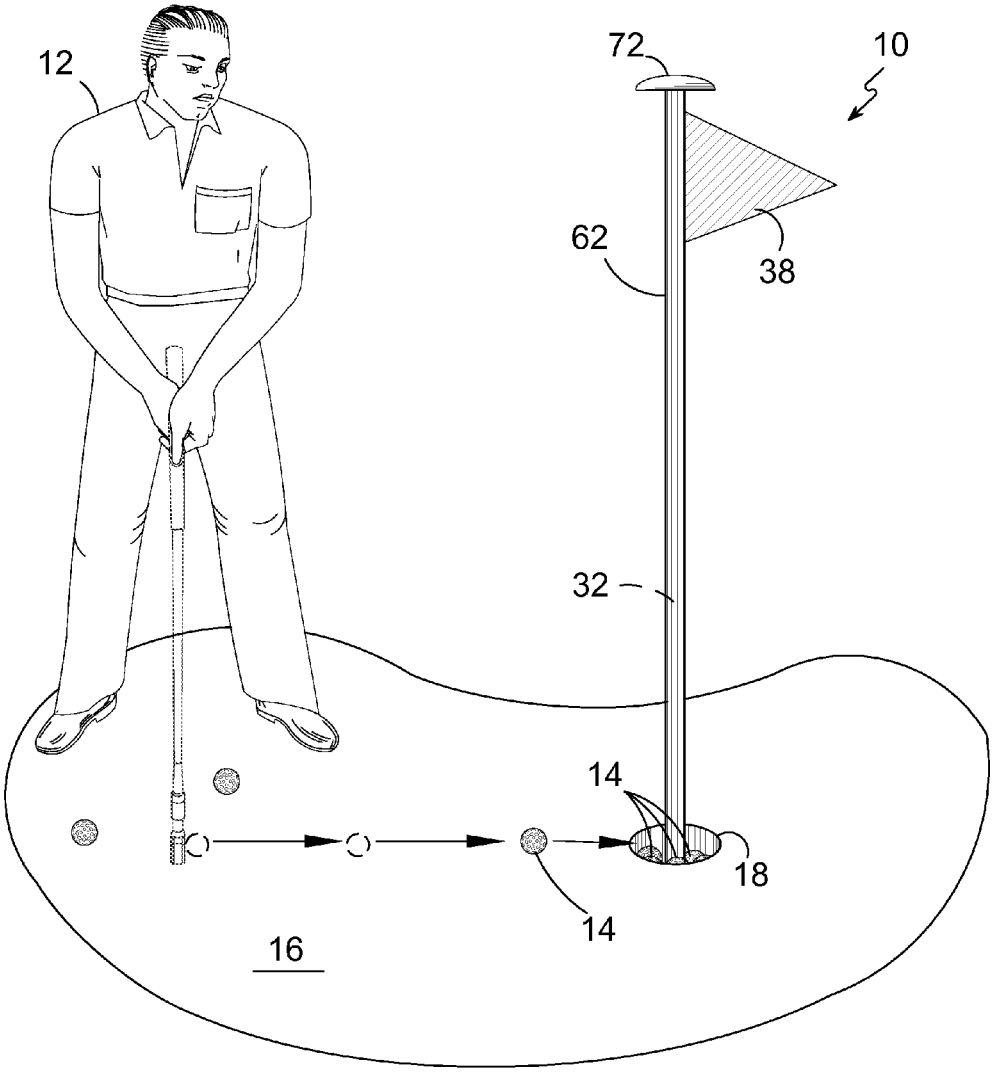
FIG. 1 is an illustrative view of the present invention in use.

Turning now descriptively to the drawings, in which similar reference characters denote similar elements throughout the several views, the figures illustrate the Golf Ball Ejection Device of the present invention. With regard to the reference numerals used, the following numbering is used throughout the various drawing figures.

10 Golf Ball Ejection Device of the present invention
12 user
14 golf ball
16 green
18 hole-cup
20 ferrule
22 ferrule plug
24 mast sleeve
26 mast-sleeve cap
28 mast-sleeve-cap bore
30 mast-sleeve-cap line-cavities
32 mast rod
34 palm button
36 palm-button mast seat
38 flag
40 flag barrel
42 flag-barrel bore
44 flag-barrel stop
46 flag-barrel-stop-bore
48 ejector-sleeve stop
50 ejector-sleeve-stop bore
52 mast-rod stop
54 mast-rod-stop bore
56 line
58 mast-rod line fastener
60 ejector-sleeve dome
62 ejector sleeve
64 ejector-sleeve cap
66 ejector-sleeve-cap bore
68 ferrule-plug rings
70 ferrule dome fastener
72 ejector-sleeve lifter
74 ejector-sleeve mast-sleeve aperture
76 pulley

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Referring to FIG. 1, shown is an illustrative view of the present invention in use. Shown is a golfer 12 practicing their putting on green 16 having hole-cup 18 using the flag-pin of the present invention that serves as a golf ball ejection device 10. The golf ball ejection device 10 comprises mast rod 32 and ejector sleeve 62 that is slidably movable along mast rod. An ejector sleeve lift 72 is fixedly attached to the ejector sleeve that can be manually moved by hand or golf club which will raise ejector sleeve 62 and ejector sleeve dome 60 that when raised approximate ground level will radially eject the balls away from hole-cup 18.

Figure 2:
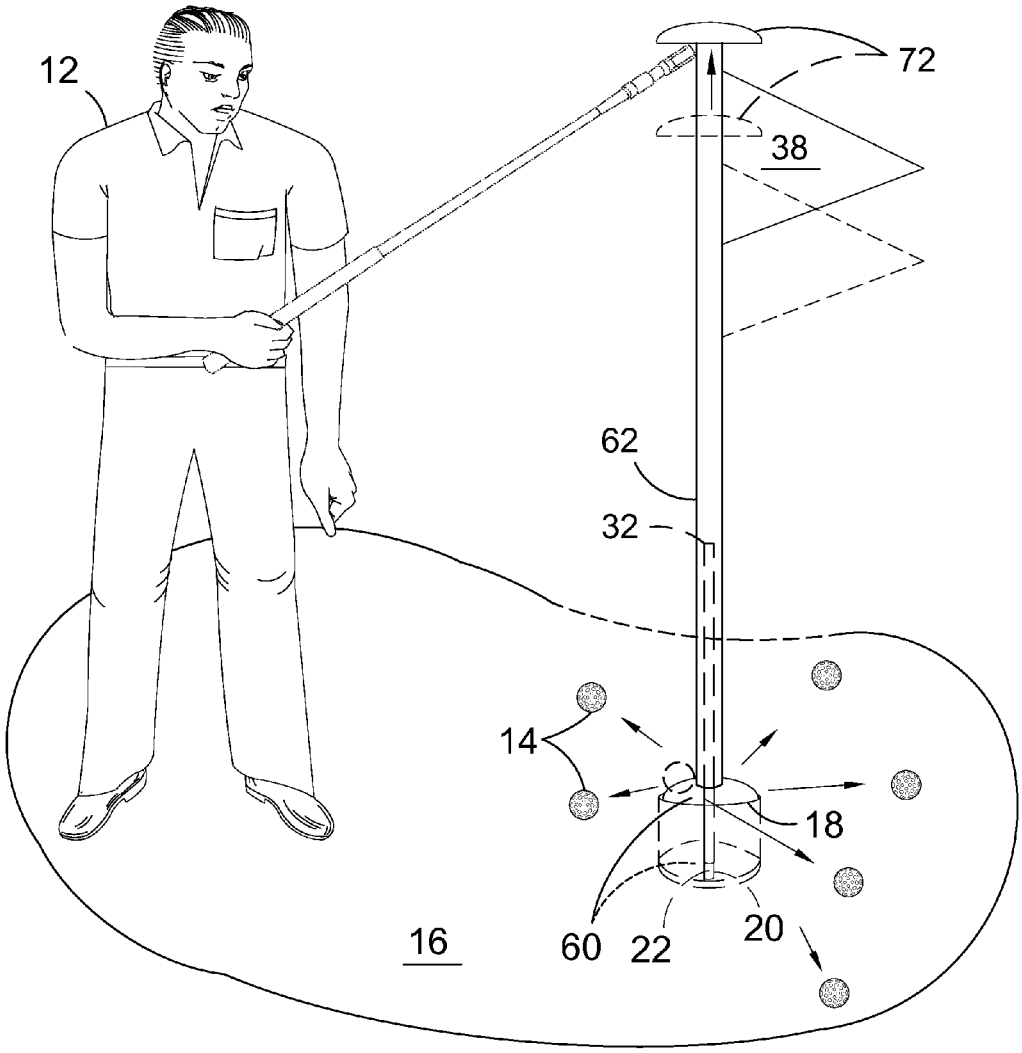
FIG. 2 is an illustrative view of the present invention in use

Referring to FIG. 2, shown is an illustrative view of the present invention in use. Shown is golfer 12 applying manual pressure to the movable component of the golf ball ejector device 10 of the present invention. In its simplest embodiment, the present invention provides a mast rod 32 and ejector sleeve 62 where mast rod 32 is removable anchored in ferrule 20 of hole-cup 18 by ferrule plug 22 and ejector sleeve 62 having a top end and a bottom end with a through bore extending there between encompasses mast rod 32 incorporating an ejector-sleeve dome 60 fixedly attached to the bottom end of the ejector sleeve 62 and an ejector sleeve lift 72 fixedly attached to the top end of the ejector sleeve whereby a user can use their putter to hook the lift and raise the ejector sleeve so that the golf balls 14 contained in hole-cup 18 will be ejected from the hole-cup when the ejector-sleeve dome reaches ground level.

Figure 3:
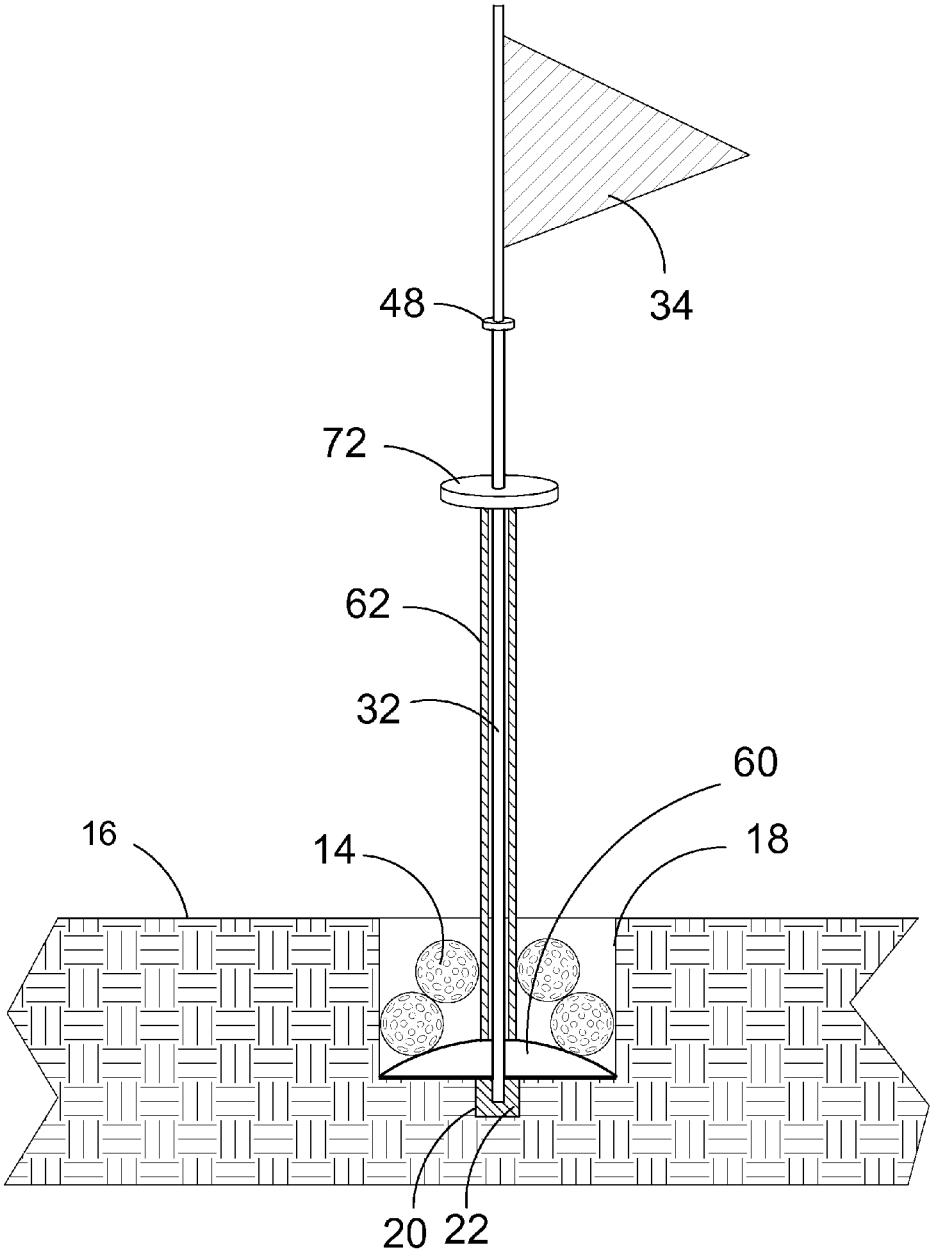
FIG. 3 is an illustrative view of the present invention in use.
Figure 4:
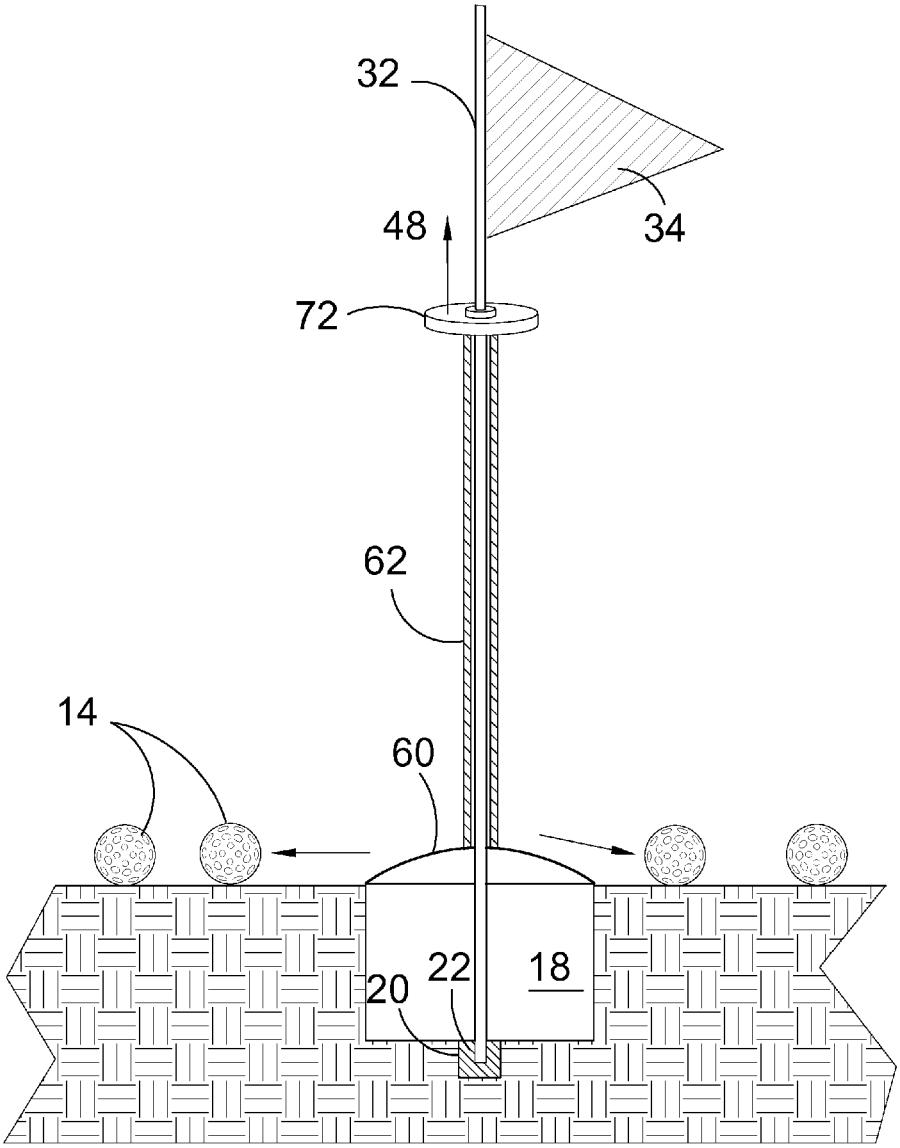
FIG. 4 is an illustrative view of the present invention in use.

Referring to FIGS. 3 and 4, shown is an illustrative view of the present invention in use. In its simplest embodiment, the present invention provides a mast rod 32 and ejector sleeve 62 where mast rod 32 is removable anchored in ferrule 20 of hole-cup 18 by ferrule plug 22 and ejector sleeve 62 having a top end and a bottom end with a through bore extending there between encompasses mast rod 32 incorporating an ejector-sleeve dome 60 fixedly attached to the bottom end of the ejector sleeve 62 and an ejector sleeve lift 72 fixedly attached to the top end of the ejector sleeve whereby a user can use their putter to hook the lifter and raise the ejector sleeve so that the golf balls 14 contained in hole-cup 18 will be ejected from the hole-cup when the ejector-sleeve dome reaches ground level. Mast rod 32 further provides ejector-sleeve stop 48 that is fixedly attached at a predetermined point on mast-rod 32 so that when the ejector sleeve is raised the ejector-sleeve dome lower rim is approximately ground level where-then the sloped surface of the dome will cause the golf balls to radially travel from the flag pin. Also shown is mast rod 32 having flag 38 mounted thereon.

Figure 5:
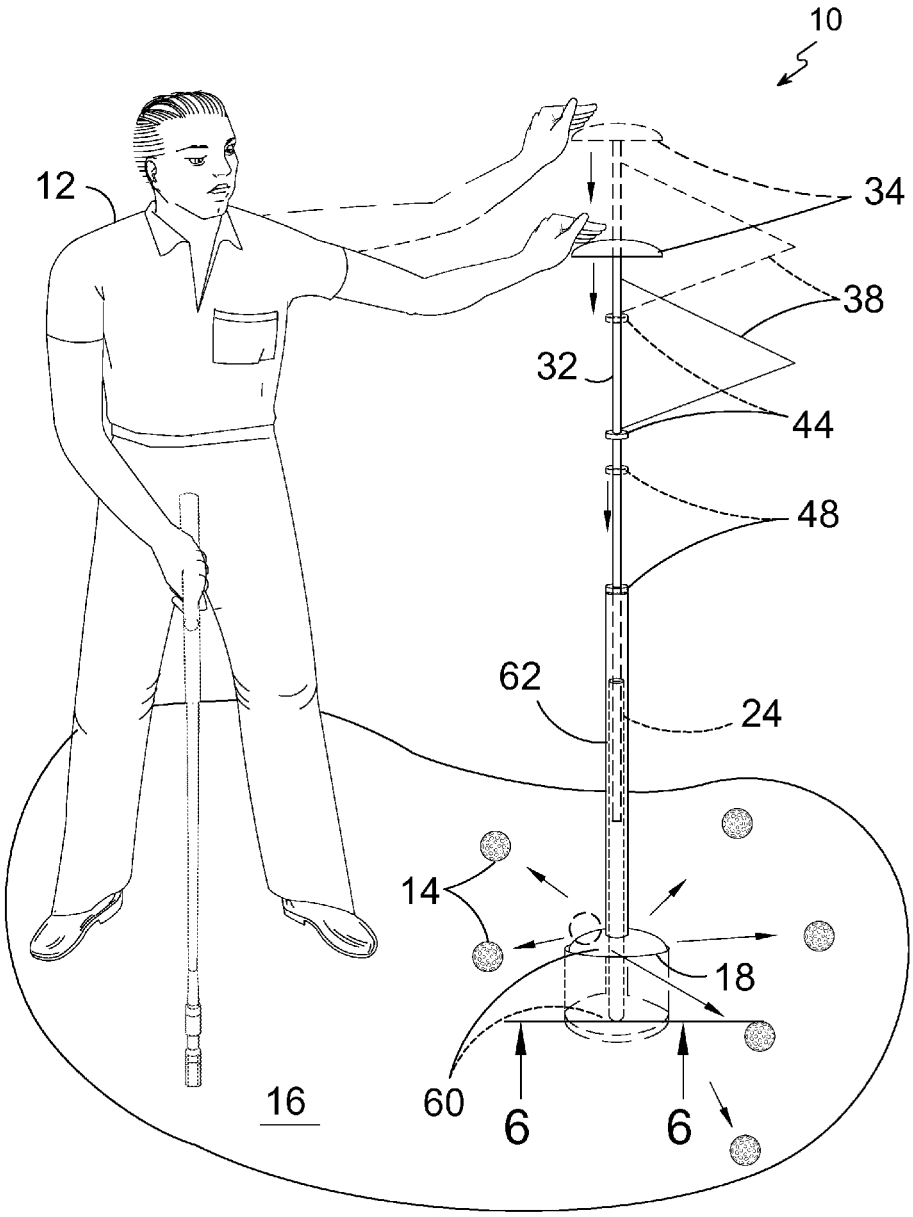
FIG. 5 is an illustrative view of another embodiment of the present invention in use.

Referring to FIG. 5, shown is an illustrative view of another embodiment of the present invention in use. As aforementioned, in its simplest the present invention 10 provides an anchored mast rod and movable ejector sleeve. The present invention also provides for a mast rod 32 that is movably suspended within a mast sleeve 24 and tethered to the ejector sleeve 62 so that downward movement of the mast rod 32 is the actuator for raising the ejector sleeve 62. As illustrated golfer 12 practicing his putting on green 16 is ejecting golf balls 14 from hole-cup 18 by applying a downward pressure on palm button 34 where again the ejector-sleeve stop 48 prevents further movement of the ejector sleeve 32 with the ejector-sleeve dome 60 positioned approximate ground level with the sloped surface causing the balls 14 contained within hole-cup 18 to radially travel away from hole-cup 18. Also depicted is flag 38 and flag-barrel stop 44.

Figure 6:
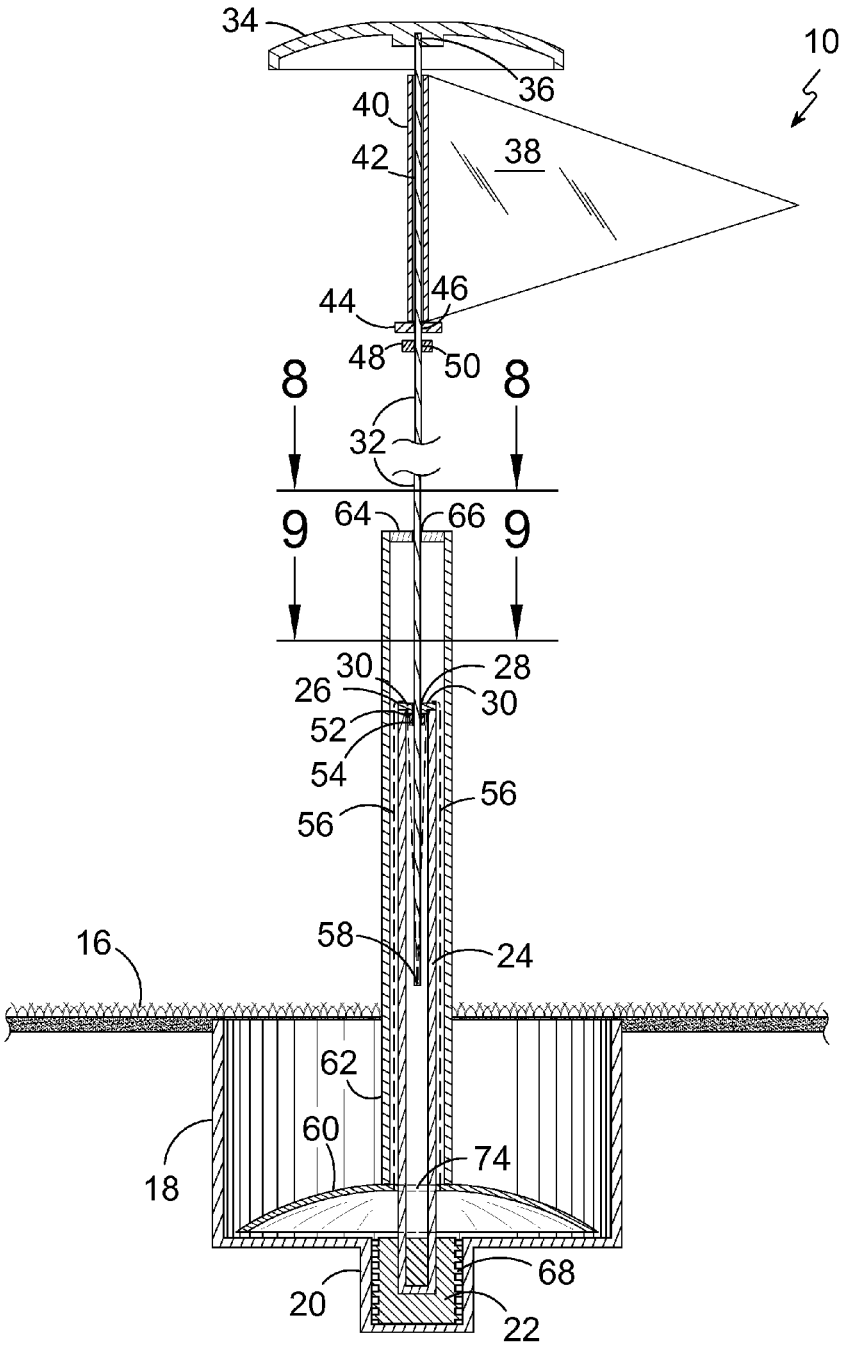
FIG. 6 is a cross sectional view of the present invention, taken from FIG. 5 as indicated.

Referring to FIG. 6, shown is a cross sectional view of the present invention, taken from FIG. 5 as indicated. Shown is golf green 16 having hole-cup 18 and ferrule 20 with the golf ball ejection device 10 positioned therein. Golf ball ejection device 10 primarily comprises a mast rod 32 tetheredly suspended within mast sleeve 24 by line 56 which is fixedly attached to ejector-sleeve 62 dome 60 so that downward pressure of mast rod 32 causes ejector sleeve 62 and attached dome 60 to rise thereby ejecting any golf balls contained within hole-cup 18. Ejector sleeve 62 functions in similar matter as that shown in FIGS. 1 and 2. Basically it sits in hole-cup 80 and when desired the balls contained therein can be ejected through manual manipulation of a movable golf ball ejection device 10 movable component The flag pin mast is comprised of mast rod 32 and mast sleeve 24 with the mast rod forming the actuatable component for raising the ejector sleeve 62, preferably by applying downward pressure on provided palm button 34 equipped with palm-button mast seat 36 for mounting the palm button to the mast rod. The palm button 34 is provided as a simple mechanism for a user to apply downward pressure to the mast rod 32 thereby actuating the ejection of golf balls contained in hole-cup 18.

The present invention further envisions that there is a need for customizing special events. Therefore, the present invention provided a golf flag pin with a flag barrel 40 having flag-barrel bore 42 as means for mounting and dismounting various flags 38 onto mast rod 32 thereby enabling flags to be easily changed to a plurality of flags specifically designed to denoted a special event. Mast rod 32 provides flag-barrel stop 44 which may be an integral part of the mast or provide flag-barrel-stop bore 46 whereby the flag-barrel stop 44 can be adjustably positioned and fastened onto the mast rod to accommodate flags of varying lengths.

Mast rod 32 also provides ejector-sleeve stop 48 for limiting the vertical rise of the ejector sleeve 62 with the ejector-sleeve stop 48 also providing an ejector-sleeve-stop bore 46 whereby the positioning of the ejector-sleeve stop 48 can also vary.

Further provided is mast-rod line fastener 58 positioned approximately to the base of mast rod 32 whereby line 56 can be fastened thereto and mast-rod stop 52 having mast-rod-stop bore 54 with mast-rod stop 52 limiting the vertical rise of the mast rod once pressure is removed from palm button 34.

Mast sleeve 24 has a top end and a bottom end with a through bore extending there between with the bottom end having attached ferrule plug 22 that alternately provides ferrule-plug 22 with spaced apart ferrule-plug rings 68 serving as frictional elements for frictionally engaging the interior wall of ferrule 20.

The top end of mast sleeve 24 has mast-sleeve cap 26 fixedly attached containing a mast-sleeve-cap bore 28 for receiving mast rod 32 therein. Cap 26 also provides spaced apart peripheral cavities serving as mast-sleeve-cap line-cavities 30 for extending line 56 from the mast-rod line fastener 58 through cavities 30 then secured to the ejector-sleeve dome 60.

Ejector sleeve 62 has a top end and a bottom end with a through bore extending there between with dome 60 fixedly attached to the bottom end while the top end has an ejector-sleeve cap 64 containing ejector-sleeve-cap bore 66 receiving mast sleeve 32 there through.

The cyclical operation of ejecting the golf balls contained in the hole-cup is performed by the user applying downward pressure on the mast rod's palm button 34 causing the mast rod 32 downward into the mast sleeve 24 resulting in the line 56 attached to the mast-rod line fastener 58 downward which draws the line across the mast-sleeve-cap line-cavities 30 exerting an upward force on the ejector sleeve's dome 60 thereby raising the ejector sleeve 62 preferably to the point where it engages the ejector-sleeve stop 48 mounted on the mast-rod 32. The ejector-sleeve dome 60 stops approximate ground level where the sloped surface of the dome causes the balls to radially roll away from the flag pin while prevent any balls from rolling back into the hole-cup 18. Once the user releases the palm button 34, the weight of the ejector sleeve 62 applies a downward fore on line 56 moving the mast rod 32 upward until mast-rod stop 52 engages the mast-sleeve cap 26 preventing further vertical movement of the mast rod 32.

Figure 7:
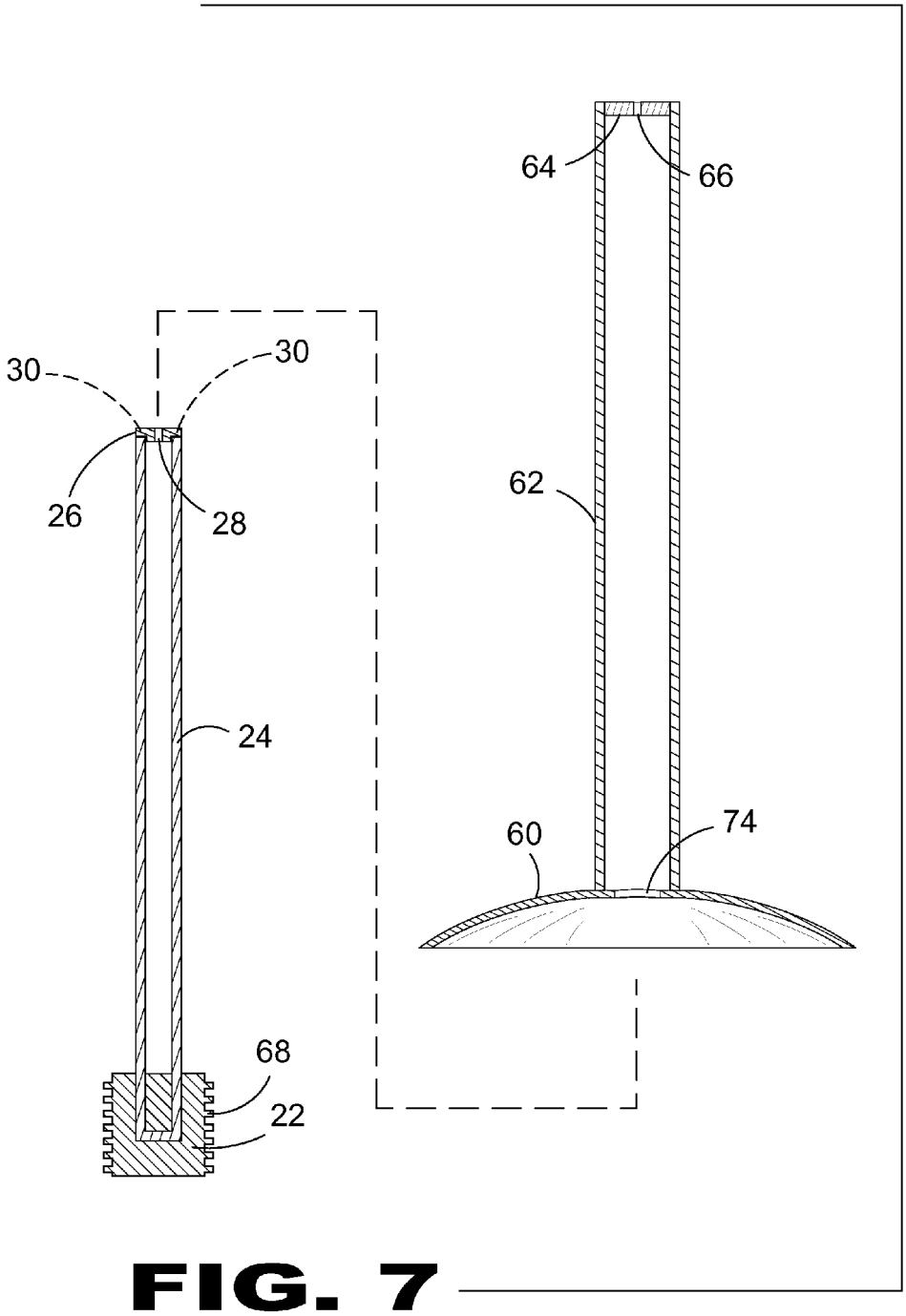
FIG. 7 are the ejector sleeve and mast sleeve of the present invention.

Referring to FIG. 7, shown are the ejector sleeve and mast sleeve of the present invention. The ejector sleeve 62 has a top end and a bottom end with a bore extending there between with the top end having an ejector-sleeve cap 64 containing an ejector-sleeve-cap bore 66 for passage of the mast rod 32, while the bottom end has a dome shaped element 60 that is positioned within the base of the hole-cup 18. The dome shaped element 60 has a centrally position aperture 74 thereby enabling the mast sleeve 24 to be inserted within the ejector sleeve 62.

The mast sleeve 24 has a top end and a bottom end with a bore extending there between with the bottom of the mast sleeve having a ferrule plug 22 attached that optionally provides the ferrule plug 22 with spaced apart ferrule-plug rings 68 that serve as frictional elements for engaging the interior wall of the hole-cup ferrule 20 when placed therein. The top end of mast sleeve 24 has mast-sleeve cap 26 fixedly attached containing a mast-sleeve-cap bore 28 for receiving mast rod 32 therein. Cap 26 also provides spaced apart peripheral cavities serving as mast-sleeve-cap line-cavities 30 for extending line 56 from the mast-rod line fastener 58 through cavities 30 then securing the line to the ejector-sleeve dome 60.

Figure 8:
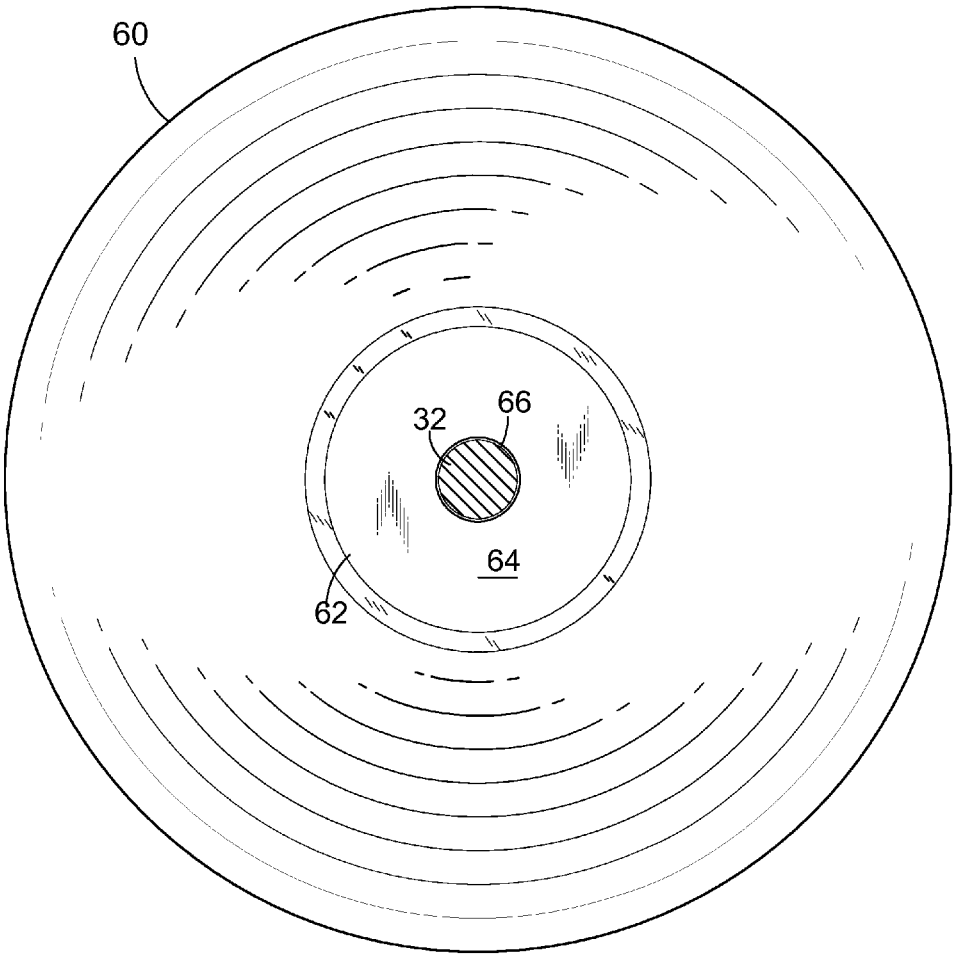
FIG. 8 is a cross sectional view of the present invention, taken from FIG. 6 as indicated.

Referring to FIG. 8, shown is a cross sectional view of the present invention, taken from FIG. 6 as indicated. Depicted is the ejector sleeve 62 encompassing ejector-sleeve cap 64 having ejector-sleeve-cap bore 66 with the mast rod 32 passing there through. Also shown is the ejector-sleeve dome 60 that is an integral part of ejector sleeve 62.

Figure 9:
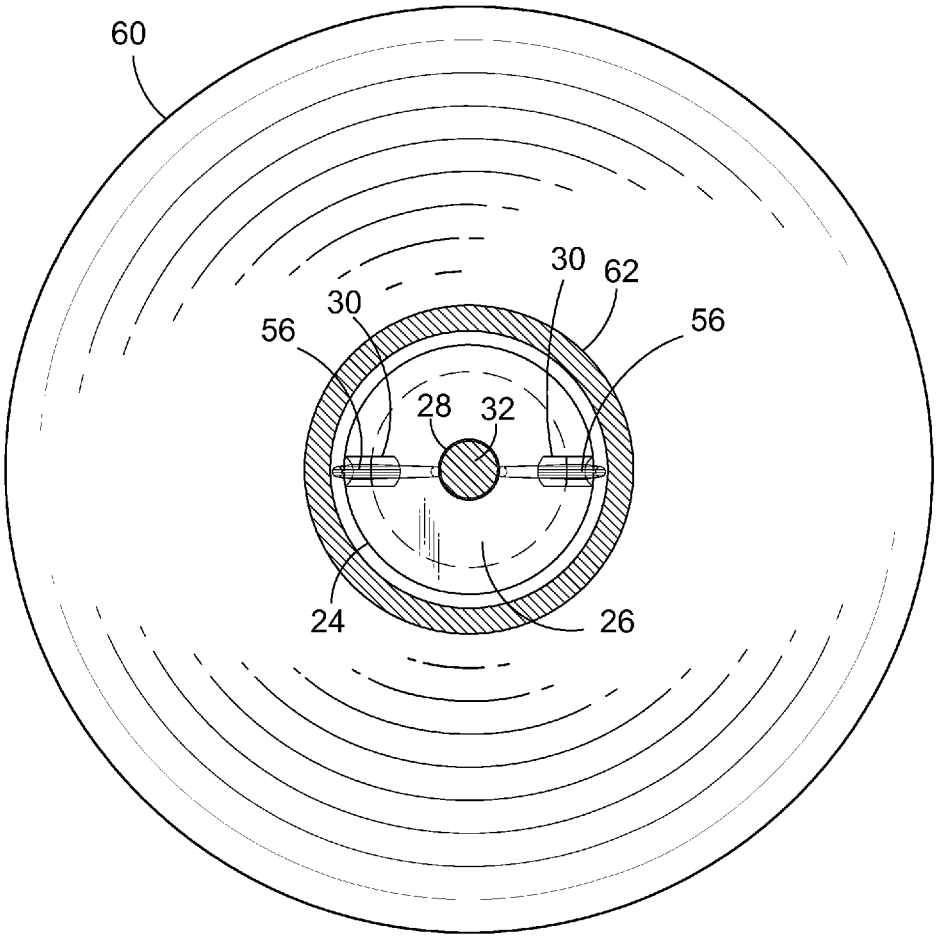
FIG. 9 is a cross sectional view of the present invention, taken from FIG. 6 as indicated.

Referring to FIG. 9, shown is a cross sectional view of the present invention, taken from FIG. 6 as indicated. Depicted is the ejector sleeve 62 encompassing mast sleeve 24 having mast-sleeve cap 26 fixedly attached there over containing a mast-sleeve-cap bore 28 having mast rod 32 therein. Also shown are peripherally positioned mast-sleeve-cap line-cavities 30 for extending line 56 there over which extend from the mast-rod line fastener through cavities 30 where it is then secured to the ejector-sleeve dome 60 within the ejector sleeve 62.

Figure 10:
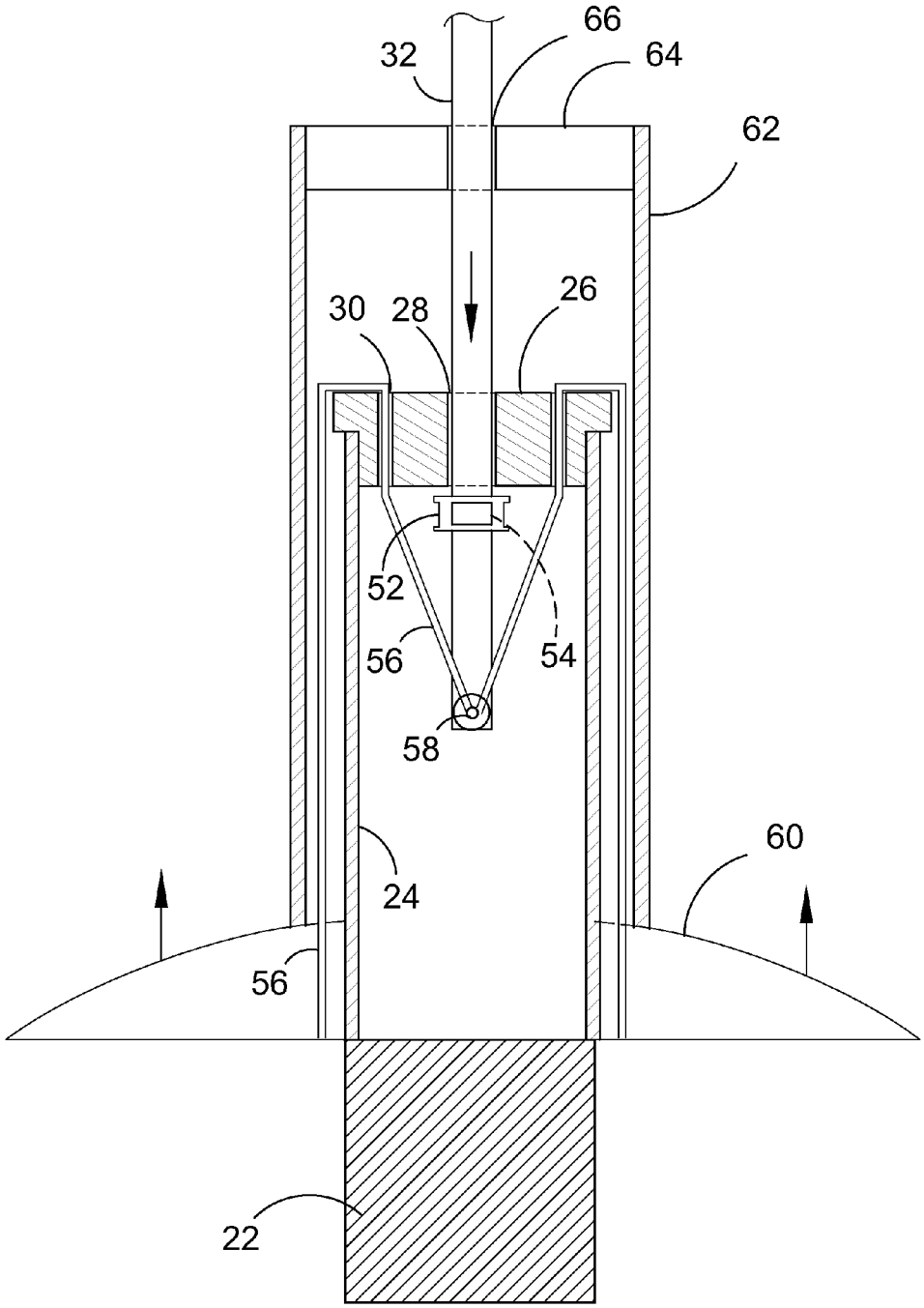
FIG. 10 is an enlarged partial view of the golf ball ejection device of the present invention.

Referring to FIG. 10, shown is an enlarged partial view of the golf ball ejection device of the present invention. The Golf ball ejection device primarily comprises a mast rod 32 tethered within mast sleeve 24 by line 56 which is fixedly attached to ejector-sleeve 62 dome 60 so that downward pressure of mast rod 32 causes ejector sleeve 62 and attached dome 60 to rise thereby ejecting any golf balls contained within hole-cup 18. Mast rod 32 also provides ejector-sleeve stop 48 for limiting the vertical rise of the ejector sleeve 62 with the ejector-sleeve stop 48 also providing an ejector-sleeve-stop bore 46 whereby the positioning of the ejector-sleeve stop 48 can also vary.

Figure 11:
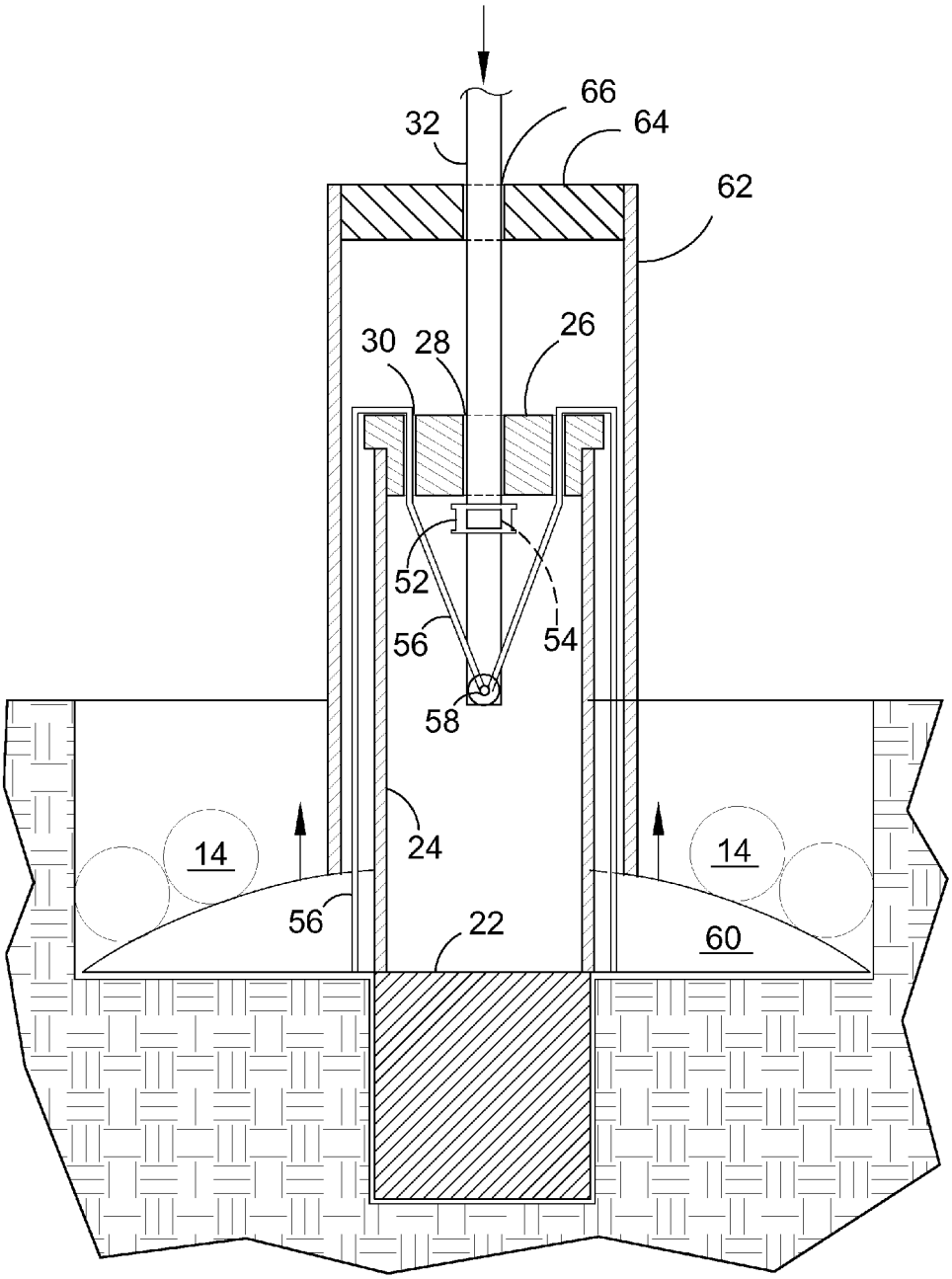
FIG. 11 is the golf ball ejection device from a seated position to an ejection position.
Figure 12:
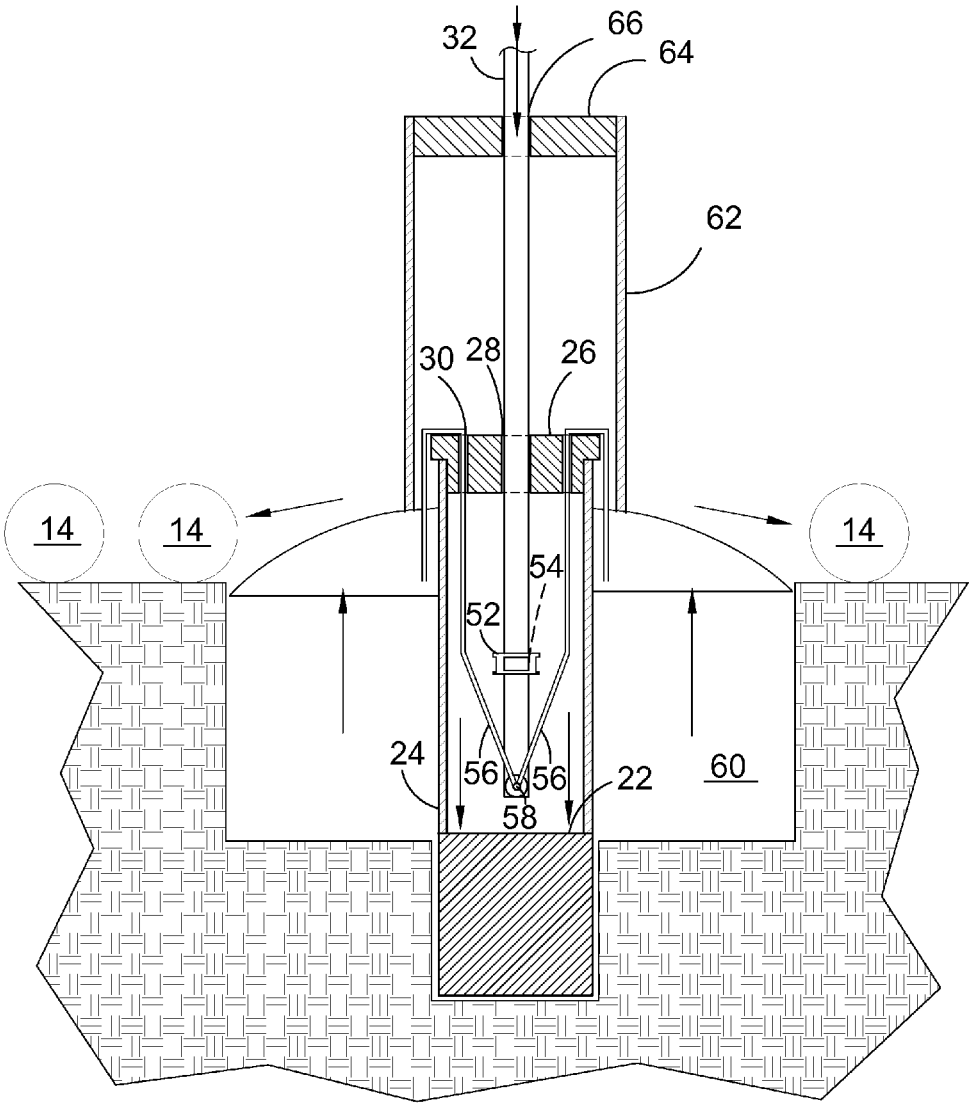
FIG. 12 is the golf ball ejection device from a seated position to an ejection position.

Referring to FIGS. 11 and 12, shown is the golf ball ejection device from a seated position to an ejection position. Downward pressure is applied on the mast rod 32 causing the mast rod 32 downward into mast sleeve 24 resulting in line 56 attached to the mast-rod line fastener 58 to move downward which draws the line across the mast-sleeve-cap line-cavities 30 exerting an upward force on the ejector sleeve's dome 60 thereby raising the ejector sleeve 62 preferably to the point where it engages the ejector-sleeve stop 48 mounted on the mast-rod 32. The ejector-sleeve dome 60 stops approximate ground level where the sloped surface of the dome causes the balls to radially roll away from the flag pin while prevent any balls from rolling back into the hole-cup 18.

Figure 13:
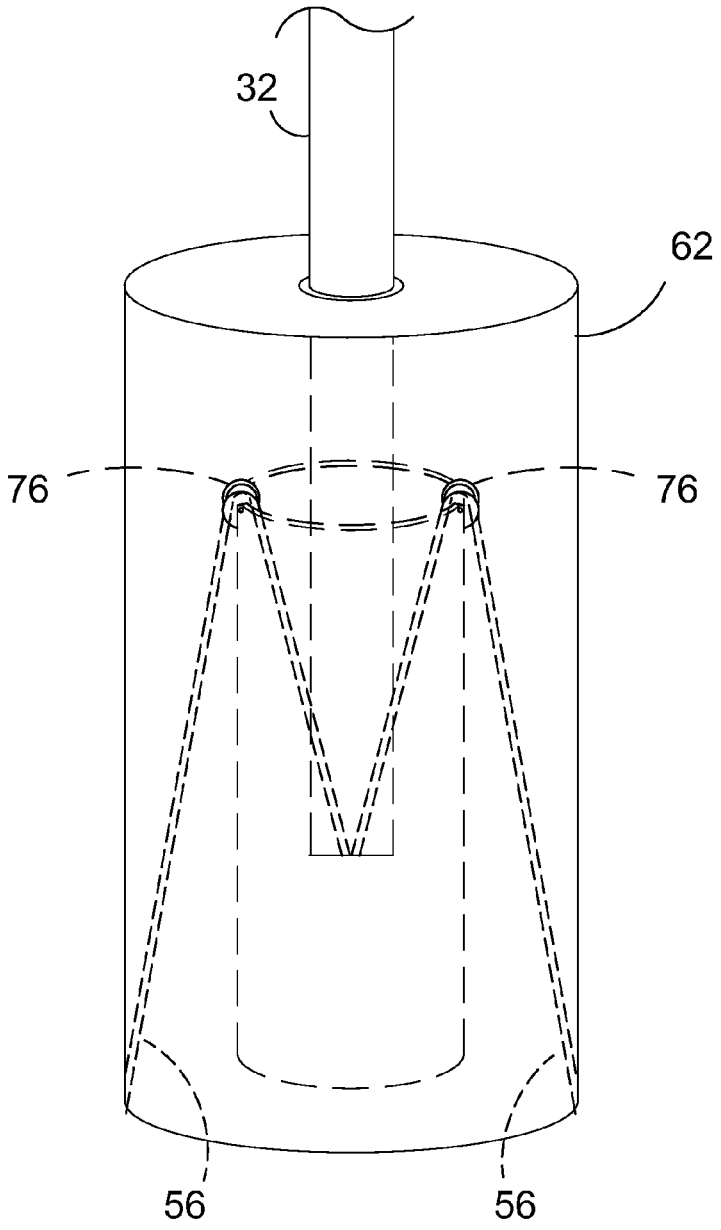
FIG. 13 is an alternate lifting device of the present invention.

Referring to FIG. 13, shown is an alternate lifting device of the present invention. Depicted is a downwardly movable mast 32 having at least one line 56 fixedly attached to the base of the mast 32 with a mast sleeve 24 encompassing the bottom portion of said mast wherein said mast sleeve 24 base is immovably anchored to a structure and incorporates spaced apart pulleys 76 for placement of said line thereover with an outer sleeve 62 encompassing said mast sleeve and tethered by said line to said mast whereby a downward force upon said mast will raise said outer sleeve 62 a distance determined by the height of said mast sleeve.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A golf ball ejection device comprising a golf flag pin having a mast rod and an ejector sleeve where said mast rod is removably positioned within a hole cup and where said ejector sleeve encompasses a portion of said mast rod and is slidably movable along said mast rod, said ejector sleeve having an ejector dome at a bottom thereof;

said mast rod comprising a mast rod portion and a mast sleeve portion where said mast sleeve portion serves as a removable anchor member for said mast rod and encompasses a bottom portion of the mast rod portion;

said mast sleeve portion having a top end and a bottom end with a through bore passing there between with the mast sleeve bottom end having a ferrule plug in said hole cup attached thereto whereby said mast sleeve is removably attached to the ferrule plug; and said mast sleeve top end has a mast-sleeve cap with a substantially central bore receiving the mast rod portion therein and a pair of peripherally positioned mast-sleeve-cap cavities providing means for extending lines therethrough.

2. The golf ball ejection device of claim 1, further comprising a mast-rod stop fixedly attached to the mast rod and positioned beneath the mast-sleeve cap that will limit the vertical travel of the mast rod within the mast-rod sleeve.

3. The golf ball ejection device of claim 1, further comprising lines attached to the mast rod and a palm button having a mast-rod seat mounted to a top of the mast rod thereby providing means for a user to apply pressure to the palm button moving the mast rod down within the mast sleeve causing the lines attached to the mast rod anchored to the dome to raise the ejector sleeve to a point where a base of the dome will be approximately ground level where then the golf balls within the hole cup will be ejected radially from the hole cup by a sloped surface of the dome.

4. The golf ball ejection device of claim 1 further comprising lines extending through said mast-sleeve-cap cavities and fixedly attached to the ejector sleeve dome so that when downward pressure is applied to the mast rod, the ejector sleeve and dome rise to a point where the golf balls within the hole cup are ejected radially from the hole cup by virtue of a sloped surface of the dome.

5. A lifting device comprising:

a) a downwardly movable mast having at least one line fixedly attached to a base of the mast;

b) a mast sleeve encompassing a bottom portion of said mast said having a mast sleeve base which is immovably anchored to a structure and incorporates spaced apart pulleys for placement of said line thereover; and c) an outer sleeve encompassing said mast sleeve and tethered by said line to said mast whereby a downward force upon said mast will raise said outer sleeve a distance determined by the height of said mast sleeve.

* * * * *